US006695525B2

(12) United States Patent
Hirschhorn

(10) Patent No.: US 6,695,525 B2
(45) Date of Patent: Feb. 24, 2004

(54) METAL CURB INSTALLATION SYSTEM AND METHOD

(76) Inventor: Richard Hirschhorn, 318 Sterling Rd., Harrison, NY (US) 10528

( * ) Notice: Subject to any disclaimer, the term of this patent is extended or adjusted under 35 U.S.C. 154(b) by 4 days.

(21) Appl. No.: 09/767,127

(22) Filed: Jan. 22, 2001

(65) Prior Publication Data

US 2002/0122697 A1 Sep. 5, 2002

(51) Int. Cl.[7] ..... E01C 11/22
(52) U.S. Cl. ..... 404/7
(58) Field of Search ..... 404/2, 7, 4, 5, 404/6, 8

(56) References Cited

U.S. PATENT DOCUMENTS

| | | | | | |
|---|---|---|---|---|---|
| 398,630 | A | * | 2/1889 | Landis | 404/7 |
| 408,057 | A | * | 7/1889 | White | 404/7 |
| 442,060 | A | * | 12/1890 | Landis | 404/2 |
| 534,441 | A | * | 2/1895 | Landis | 404/7 |
| 670,001 | A | * | 3/1901 | Morss | 404/2 |
| 691,794 | A | * | 1/1902 | Morss | 404/2 |
| 1,020,887 | A | * | 3/1912 | Cornwall | 249/4 |
| 1,034,504 | A | * | 8/1912 | Pindell | 238/9 |
| 1,185,291 | A | * | 5/1916 | Davis | 404/8 |
| 1,789,829 | A | * | 1/1931 | Moore | 404/7 |
| 1,927,388 | A | * | 9/1933 | Campbell | 404/7 |
| 1,978,491 | A | * | 10/1934 | Gladman | 404/2 |
| 3,157,098 | A | * | 11/1964 | Mason | 249/5 |
| 3,203,327 | A | * | 8/1965 | Daley | 404/7 |
| 3,208,362 | A | * | 9/1965 | Sigmund | 404/98 |
| 3,844,073 | A | * | 10/1974 | Peletz | 52/20 |
| 3,957,383 | A | * | 5/1976 | Fredericks | 404/8 |
| 4,804,292 | A | * | 2/1989 | DeLuca | 404/69 |
| 5,302,047 | A | * | 4/1994 | Ivey | 404/6 |
| 6,106,706 | A | * | 8/2000 | Roy et al. | 210/99 |
| 6,227,758 | B1 | * | 5/2001 | Missick et al. | 404/4 |
| 6,231,758 | B1 | * | 5/2001 | Morris et al. | 210/163 |

FOREIGN PATENT DOCUMENTS

| | | | | |
|---|---|---|---|---|
| DE | 3240331 A1 | * | 5/1984 | 404/7 |
| JP | 08003932 A | * | 1/1996 | E01D/19/12 |

* cited by examiner

*Primary Examiner*—Thomas B. Will
*Assistant Examiner*—Kristine Florio
(74) *Attorney, Agent, or Firm*—Eliot Gerber

(57) ABSTRACT

A straight steel curb for the steel curb faced concrete curb of a roadway has a vertical sidewall and a horizontal portion. Two sheet metal or plastic benches, which lie on the floor of the trench, are aligned relative to a string line. Each bench has a bracket which supports a bottom edge of the steel curb at its two ends, to position the steel curb. The front plate and back plate of a bench are welded to the bottom plate by a weak weld which shears under the pressure of the expanding or contracting concrete or has a pleated base which contracts and expands. The bench has front and back flanges which, respectively, hold front and back concrete forms.

8 Claims, 13 Drawing Sheets

METAL CURB INSTALLATION SYSTEM AND METHOD

FIELD OF THE INVENTION

The present invention relates to sidewalk and road construction and more particularly to systems and methods for installing concrete curb, straight and curved, faced with steel to protect the concrete from damage due to cars, trucks and snow plows.

BACKGROUND OF THE INVENTION

At the present time, in cities and in metropolitan areas, a sidewalk is located at a side of a road, e.g., street or roadway. The sidewalk is elevated typically 7" above the road (the reveal), and a curb is used to separate the road from the sidewalk. The curb has a nearly vertical face which ranges from 18' to 27" depending on the thickness of the road and the reveal of the curb. The bottom of the curb is buried 11" to 20" below the road, and has a nearly horizontal portion which lines up with the sidewalk. There is a ½"×6½"×18–27" premolded bituminous expansion joint filler (EJF) between curb sections and a ¼" expansion joint between the curb and sidewalk for expansion and contraction. When the curb and sidewalk are poured simultaneously, a ½" thick expansion joint (EJF)is generally used between the curb and sidewalk.

Plain concrete is most often used for such curbs. In high traffic areas, such as busy city streets, the concrete is rapidly chipped, cracked and broken, so a hard stone, such as granite, is often used. However, the costs of cutting, transporting and installing elongated granite curb members is high and may be prohibitive.

Steel has been used for many years to face concrete curb since it is strong and can resist damage caused by the impact of the truck wheels and snow plows when installed along streets having heavy vehicle traffic. Steel faced concrete curb is less costly than granite but as good as, or superior, in resisting damage. However, steel curb-facing (steel curb) is heavy and, because it is heavy and clumsy to handle, it is costly to install. A typical steel curb is 20 feet long, asymmetrical, and weighs about 340 pounds. It usually requires a four-man crew to lift and install a steel curb or two men with a lifting machine. The curb, during its installation, must be exactly aligned with a string guidance line. The surfaces of adjacent steel curbs must align smoothly where they join each other. If one steel curb extends beyond or above the next, it will present a sharp edge which can cut vehicle tires and present a tripping hazard to pedestrians.

To rebuild an existing road, generally the curb to be replaced is removed. A trench, 11 to 18 inches deep and 18 to 24 inches wide, is then dug. Using surveyor instruments, including a surveyor's level, a continuous guidance string is strung as a guide for the curbs. The string is supported by long steel (primary) stakes, for example, ¾-inch diameter and 36-inch long. The primary stakes are about 50 feet apart and driven into the earth at the bottom of the trench, generally along the back of the future curb. The string is the guide for the line (sidewise location) and grade (elevation) of the new curb. The curb may be straight and may be curved.

The next steps in the conventional method is to drive other stakes 1½" behind the string line, about 5 feet apart, into the earth at the bottom of the trench. These stakes hold a back (wood) form in its vertical position such that the face of the wood is on the line of the guidance string. The wood form is usually made, for example, from 2×8 (inch) and 2×12 (inch) lumber held together to form a nominal 2"×20" (actually 1½"×19"). The forms (front and back) are the mold for containing the concrete slurry which is later poured into the form. The steel curb is placed in the space between the form, against the front form.

The steel curb has a nearly vertical face, which may be about 11". Two stacks of bricks are formed, spaced, for example 19 feet apart, on the bottom of the trench. The stacks of brick range in height, typically, from 10" high for an 18" deep curb to 19"–27" for other curbs. The steel curb is lifted into the trench and set on the stacks of bricks. The curb has a series of protruding steel studs for anchoring the steel curb to the concrete curb. The stacks of brick are shifted so they are directly under the end studs (typically 3" up and 9" from each end) so they are in the position to support the curb. The stacks are inherently unstable and often topple when the curb is placed upon them. But, even if they were stable, because of the high center of gravity and a asymmetrical shape of the steel curb, the curb will not stand by itself on a stack of brick. To compensate for this when the steel curb is correctly positioned relative to the string, and while two men balance the curb, the wooden forms are placed behind and in front of the steel curb and clamped.

Each steel curb must be lifted, positioned and adjusted so that it is at the correct height relative to the guidance string. Usually wooden shims are placed on top of the stacks of bricks and beneath the steel stud for a finer adjustment. However, the conventional method described for the placement and adjustment of the steel curbs is slow, inexact and labor-intensive. The steel curb must be steadied by two men, one at each end, while 2 or 3 other men place the front and back forms and clamp them together. Wood spacers, 36" apart, are positioned between the steel curbs and wood forms to keep the steel curb and wood forms from collapsing inwardly. This conventional method is expensive because of the time required, the number of men in the crew, their skill and their relatively high wages and fringe benefits.

SUMMARY OF THE INVENTION

In accordance with the present invention, to lay a line of straight steel curbs, a trench is dug and a guidance string line is positioned in the trench.

In the primary method, in accordance with the present invention, a series of sheet metal or plastic benches, one for each piece (section) of steel curb, is provided to hold and position the straight steel curb. The benches are aligned relative to the string line. The benches are raised, or lowered, by placing or removing dirt beneath their bottom plates, until the benches are at the correct elevation. Each bench has two front plates at ⅜" apart, for expansion, each bracket having a support shelf to position and support the bottom edge of the steel curb. The benches are formed of sheet metal or plastic and are left in the trench after the concrete slurry has been poured. One bench supports the leading end of the previous steel curb and the trailing end of the next steel curb which is to be set. At that time, or after a series of straight curbs are positioned in the trench, wooden forms are removably placed on the benches. A wood form is positioned at the front (the side toward the road) against the lower 2–3" of the face of the curb. A wood form is positioned at the back, with the form extending to the height of the top lip portion (curve-dover portion) of the curb. The concrete slurry is then poured between the form and allowed to harden. The wood forms are then removed, the trench partially filled with compacted earth and crushed stone, and the road and sidewalk are laid down.

In an alternative method, especially useful for setting curved curbs, two benches are tied to the curb, one at the leading end and one at the center. The bench and curb are then lifted by the work crew and placed in the trench in the curb's line and grade. The trailing end of the curb is placed in the bracket of a previously positioned bench.

A corner steel curb, used at street corners and generally 85° to 95°, is positioned in a different way. In the first step, the corner curb is lowered by the work crew into the trench and positioned on wooden blocks which lay on the floor of the trench. In the second step the tangents of the corner steel curb are aligned with intersecting streets. In the third step, metal stakes are placed in support plates welded to the curb and are driven into the ground, at the bottom of a rounded trench. The stakes are vertical. The support plates are welded to the curb. The support plate has a bushing having a bolt and the bolt is tightened on the stake to hold the curb to the desired elevation (vertical position). A series of short metal squares have been welded to the back of the curb surface towards the sidewalk in the curb fabrication shop. The squares are used in conjunction with curb ties and a series of short metal tracks. Curb ties are connected, at their front end, to the squares. At their back end, the curb ties are connected to a metal track which had been fastened, generally in the curb fabricator's shop, fastened to a 2½"×8" or 18" continuous expansion joint which separates the back of the curb from the sidewalk. The curb ties make the expansion joint, which is flexible, follow the curvature of the steel curb, and hold it in position to resist the pressure of the concrete slurry. The curb and sidewalk are poured together.

DETAILED DESCRIPTION OF THE INVENTION

Figure 1A:
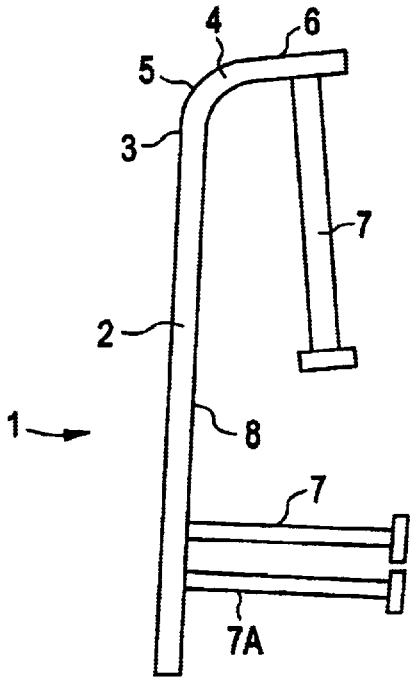
FIG. 1A is an end view of a conventional straight metal curb.
Figure 1B:
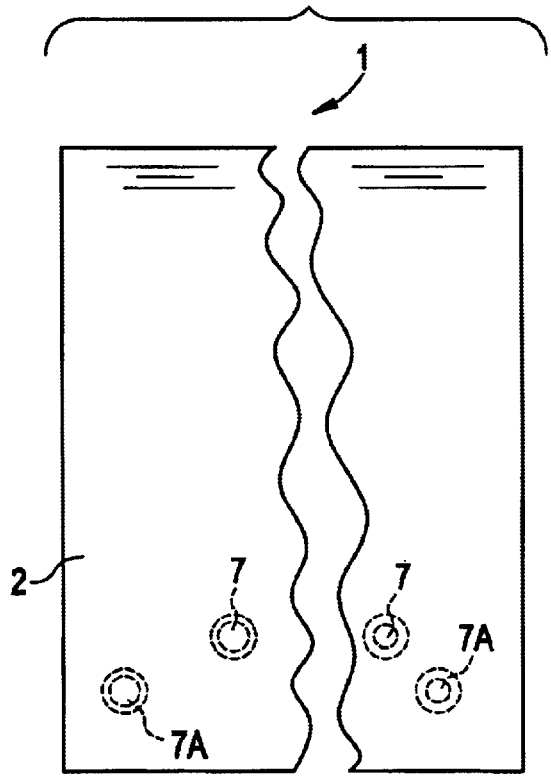
FIG. 1B is a front elevational view of the front face of the curb of FIG. 1A.

The present invention, in its first embodiment, uses a conventional straight steel curb to form a steel faced concrete curb. As shown in FIGS. 1A and 1B, the steel curb 1 consists of a nearly vertical plate portion 2 whose outer face 3 is exposed and extends from approximately 4" below the road to the level of the sidewalk. An integral lip portion 4 has a curved edge 5 and is positioned so that its top surface 6 is at the level of the sidewalk.

A series of concrete stud anchors 7 (studs) are welded to the back face 8 of the curb 1, for example, spaced 1-foot apart, and act to anchor the curb in the concrete. In addition, two bench studs 7A, near the opposite ends of the curb 1, are used in conjunction with loose wedge to balance and set the verticality of the curb, see FIG. 7.

Figure 3:
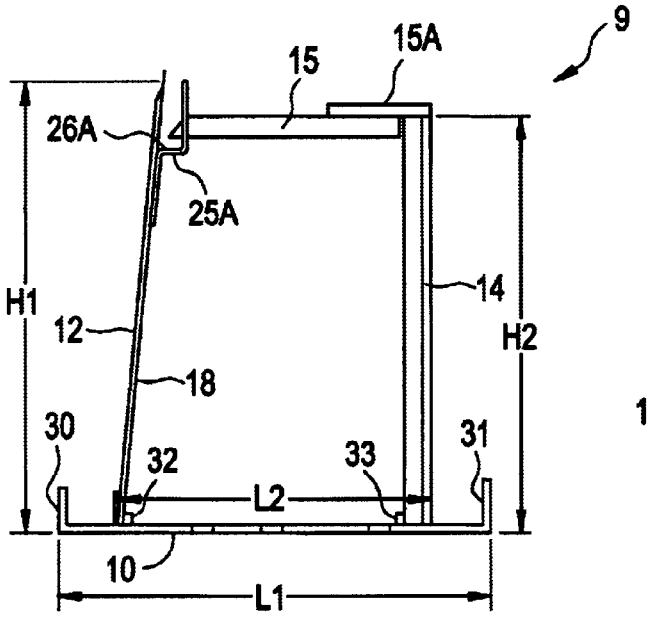
FIG. 3 is an end view of the bench of the present invention.
Figure 5:
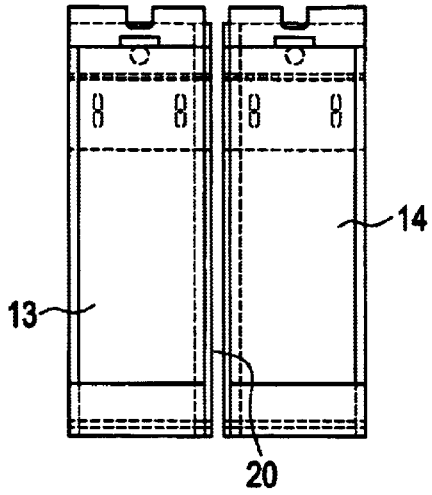
FIG. 5 is a back elevational view of the bench of FIG. 3.
Figure 4:
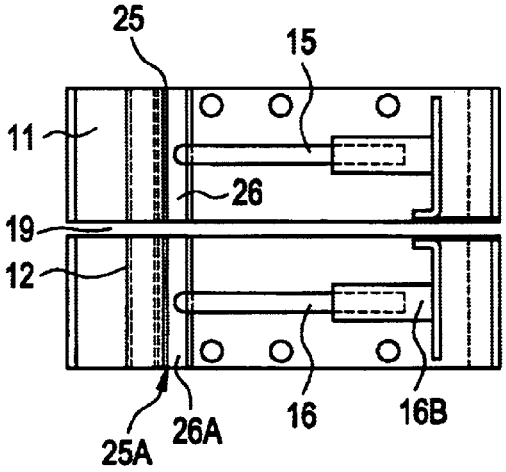
FIG. 4 is a plan view (top view) of the bench of FIG. 3.

The metal or plastic curb bench 9 of the present invention is shown in FIGS. 3–5. It comprises a bottom sheet metal or plastic plate 10 having a length "L1", two front sheet metal plates 11,12 having a height "H1", two back sheet metal plates 13,14 having a height "H2". The plates are welded or injected (if plastic) together to form a unitary structure. The front plates 11,12 are preferably not plumb in respect to the bottom plate 10 but are inclined at an 84° angle or 6° out of plumb. Front plates 11,12 and support brackets 25 and 25A and the back plates 13,14 are each separated by gaps 19,20; preferably the gaps are each about ⅜" for the front plates and ½" for the back plates and support brackets.

The typical dimensions for 18" curbs are: L1, 11 27/32 inches; L2, 8 23/32 inches; and the sheet metal is 10 GA.

It will be understood that these dimensions, as well as the other preferred dimensions set forth, are only by way of example and may vary depending on the thickness of the roadway and the curb reveal and depending on local conditions and construction practices.

The front plates 12 and 13 carry a sheet metal bracket member 25 on its interior face. The support bracket member 25 forms a shelf 26 which supports the bottom edge of one end of the steel curb 1.

A front flange 30 (vertical protrusion) is integral with the bottom plate and a back flange 31 (vertical protrusion) is also integral with the bottom plate 10. The flanges 30,31 are used to hold the bottom edges of the front and back wood forms, respectively, in position. These flanges are used instead of the conventional method of holding the bottoms of the forms in position against the hydrostatic force of the concrete slurry by shoveling a pile of earth against the outside faces of the forms. Generally the earth will be removed, after the concrete has hardened, which is labor-intensive. The flanges 30–31 are preferably 1¾ inches in height.

The front plate 12 and back plate 13 are welded to the bottom plate 10 by two pairs each of relatively weak welds 32,33, respectively. These welds are adapted to break due to force of the expansion and contraction of concrete and steel faced curb resulting from changes in length due to temperature changes. Alternately, the bottom plate may be formed with pleats to act in an accordion-like manner to provide the expansion.

Figure 2:
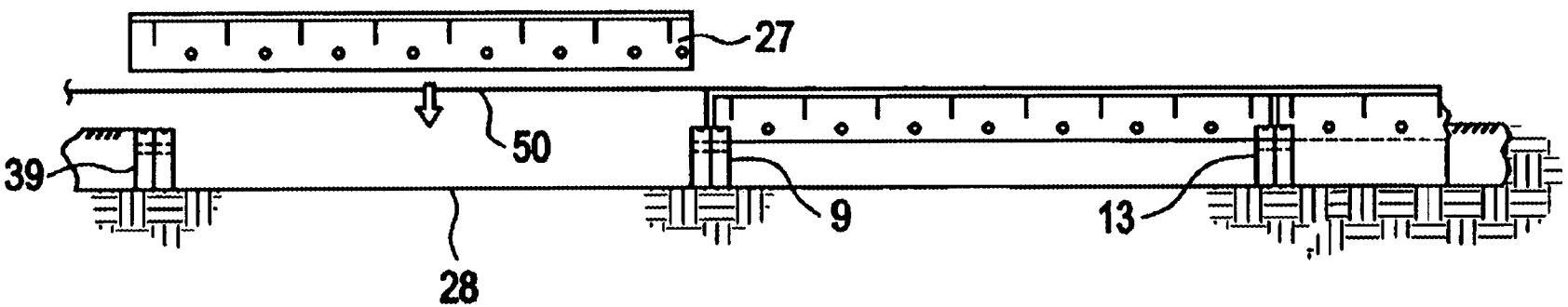
FIG. 2 is a front elevational view of the front face of two full curbs, of the type of FIG. 1, one in a trench and one about to be placed in a trench.

As shown in FIG. 2, at the start of the line of curbs, the first bench (not shown) of FIG. 3 is positioned without the curb being attached to it. The bottom plate 10 of the bench is positioned on the ground 28 of the trench a distance below the taut guidance string 50 (string line) equal to the depth of the curb, for example 18" to 27". If the bench is too high relative to the string line, a little earth is removed from beneath the bottom plate 10 or, after it has been set, the steel curb can be hammered down, causing the bench to sink slightly into the previously compacted earth. If the bench is too low, some earth, or a shim, is put under the bottom plate 10. As described in detail below, the trailing end of the steel curb is placed by the work crew on the shelf 25 of the bracket member 26. Since the bench was already correctly positioned in relation to the guidance string line 50, when the leading end of the preceding curb was placed, the trailing end of the next steel curb is correctly positioned as soon as it is lowered into the shelf 26A bracket member 25. The crew does not need to re-position or measure that the trailing end of the curb, as that end is correctly positioned as to line and elevation. Using a loose wedge between the trailing end bench stud 7A and bench batter plate 16B, the face of the curb is battered to match the proximate curb 1:10 or 6° out of plumb.

A ½-inch gap is left between the ends of the two proximate steel curbs and that gap is filled with a piece of expansion joint.

After a number of steel curbs are in place, supported and aligned by the benches, the forms will be laid on the bench bottom plate 10 between the bottom plate flanges and the front and back plate. The forms are preferably lumber boards, although alternatively they may be sheet metal or plywood.

Figure 6:
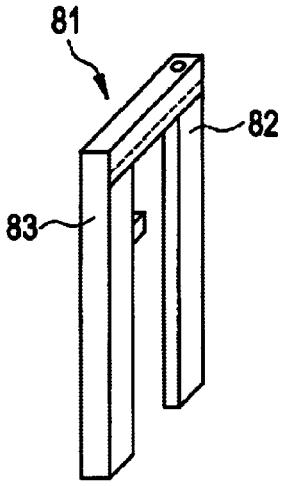
FIG. 6 is a perspective view of a tubular steel clamp.

A form clamp of tubular steel 81 (tubular curb clamps) is used in place of the conventionally used inverted U bent generally from ¾" round or square steel bar. The clamp 81 comprises a first member 82, which is positioned behind the back form, a front member 83 positioned in front of the front face of the front form, and a connecting top member 81, see FIG. 6B.

Figure 7:
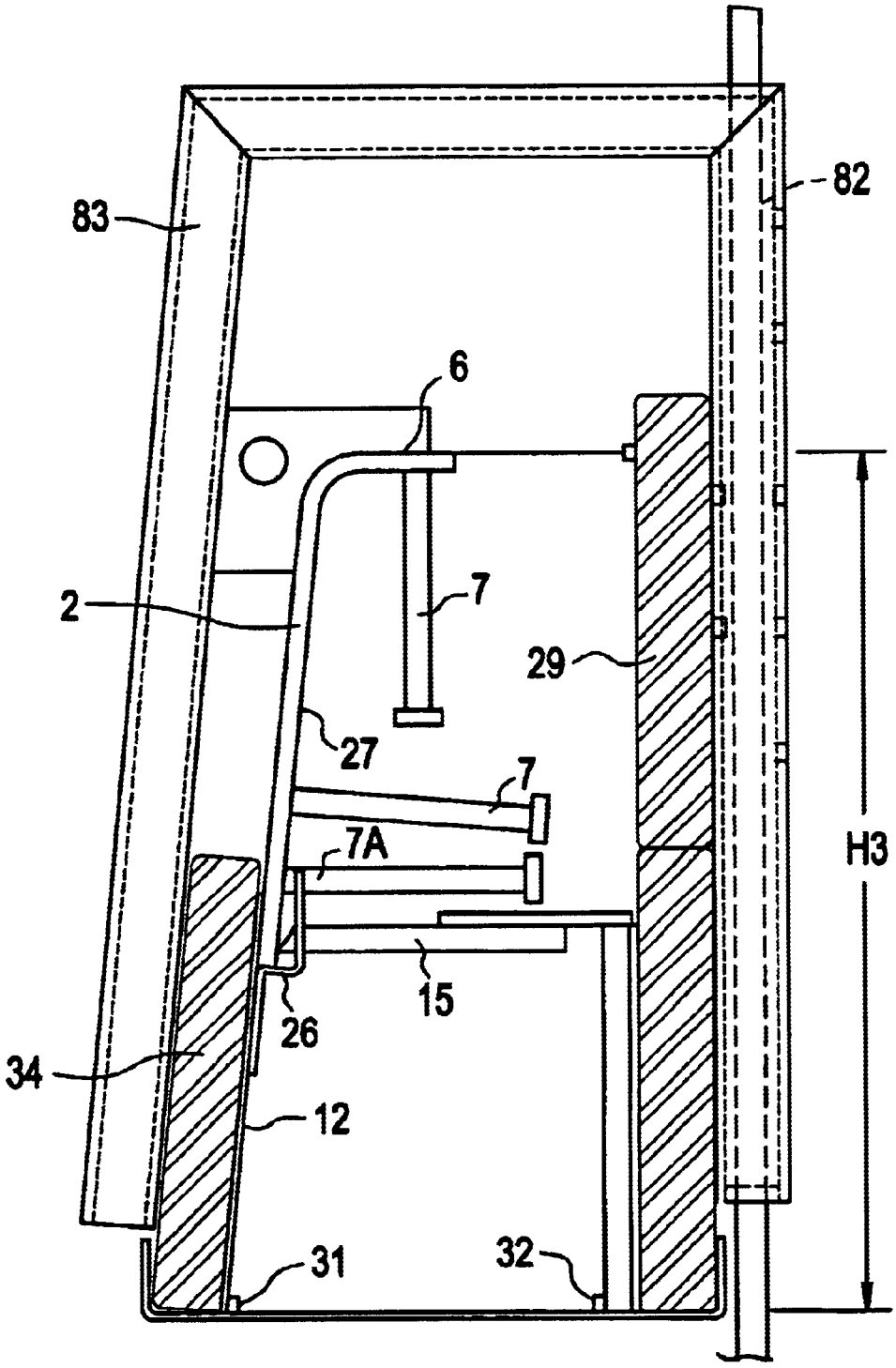
FIG. 7 is an end view of the bench of FIG. 1 in a trench.

As shown in FIG. 7, the back form 29 is made of two pieces of lumber spliced longitudinally, as in the conventional method. The back form 29 is removably attached to two benches 9 and 39 supporting the two ends of the steel curb 27, see FIG. 2. The back form 29 is at least the full height to the top of the curb 27, preferably 21 inches high, when the full height H3 is 21 inches.

A front form 34, preferably is a single piece of lumber removably attached by curb form clamps to the front faces of the two benches 9,39 lapping over the steel curb a minimum of 2".

Preferably, in addition to the two benches at the opposite ends of a steel curb, the front form and back form are prevented from bowing at the bottom due to the hydrostatic pressure of the concrete slurry by "Curb Form Bottom Ties" (CFBT) and at the top by tubular curb clamps. Typically the CFBTs are placed on the trench floor, at 5 feet spacing, between the two benches and the top tubular clamps are lined up over the CFBT.

Figure 8:
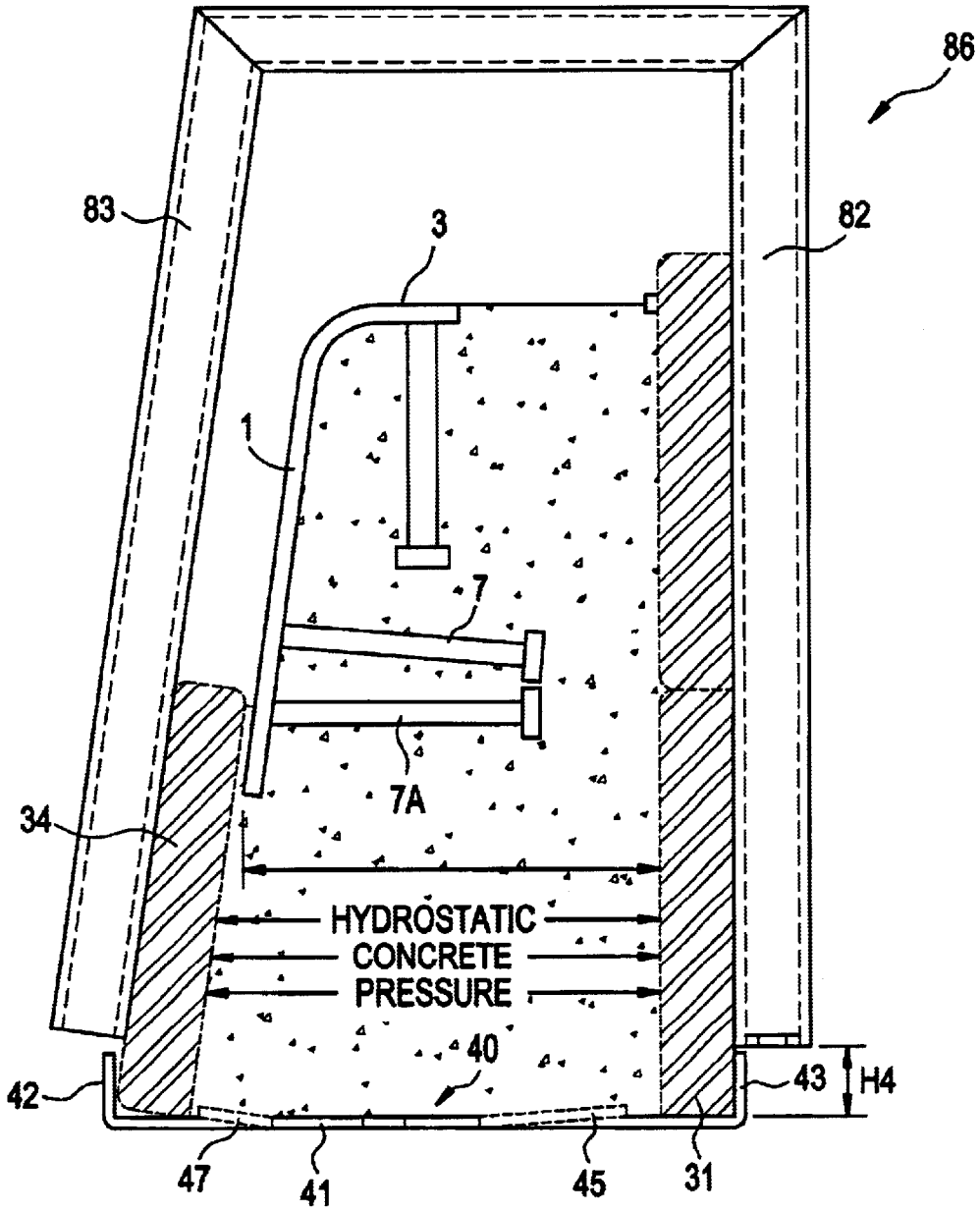
FIG. 8 is a sectional view of a straight curb within a curb form and having a curb form bottom tie.
Figure 9:
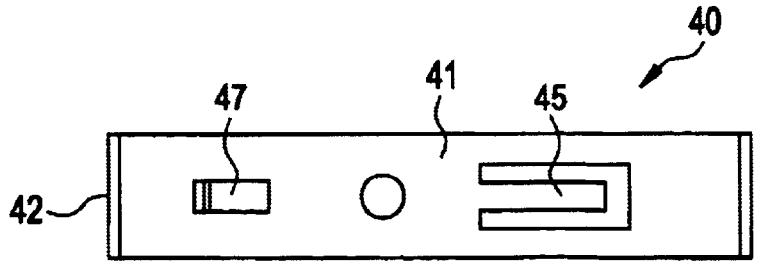
FIG. 9 is a top plan view of a curb form bottom tie.

As shown in FIGS. 8 and 9, the CFBT 40 consists of a bottom 41, a front flange 42 (vertical protrusion) and a back flange 43. The flanges 42,43 are preferably 1¾ inches high (H4). The three CFBTs are placed on the trench floor preferably so that their back flange is 3" to 4" behind the guidance string i.e. further from the road than the guidance string. Then the back form is placed on the bench bottom plate between the back plate 14 and the flange 31. Next, all 3 CFBTs are moved until their flanges touch the back form. Then the back finger 45 of each is raised (field bend up), for example, by the claw of a claw hammer. That back finger 45 holds the CFBT from being dislocated by the placement of the front form. The bottom edge of the front form 34 is then placed between the flange 42 and the front finger 47, which has previously been bent upwards in the shop. The bottom edge of the back form 31 is then placed on the bench bottom plate against flange 43.

Figure 10:
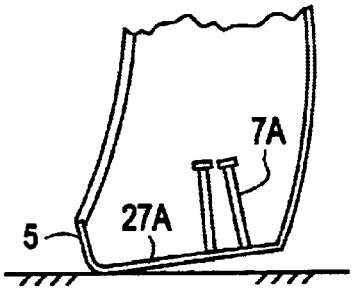
FIG. 10 is an end view of a curved steel curb lying on its face.
Figure 11:
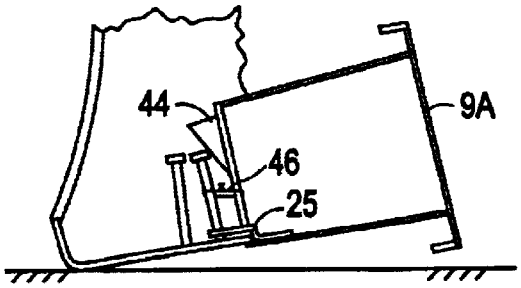
FIG. 11 is an end view of the curb of FIG. 10 lying on its face and tied to a bench.
Figure 12:
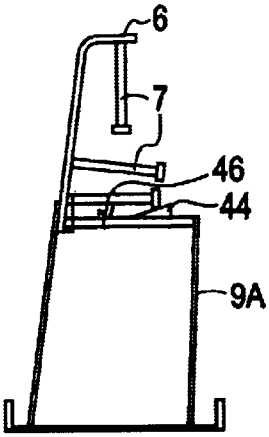
FIG. 12 is an end view of the curb of FIG. 10 tied to a bench and positioned at its final attitude, its face nearly vertical.
Figure 13:
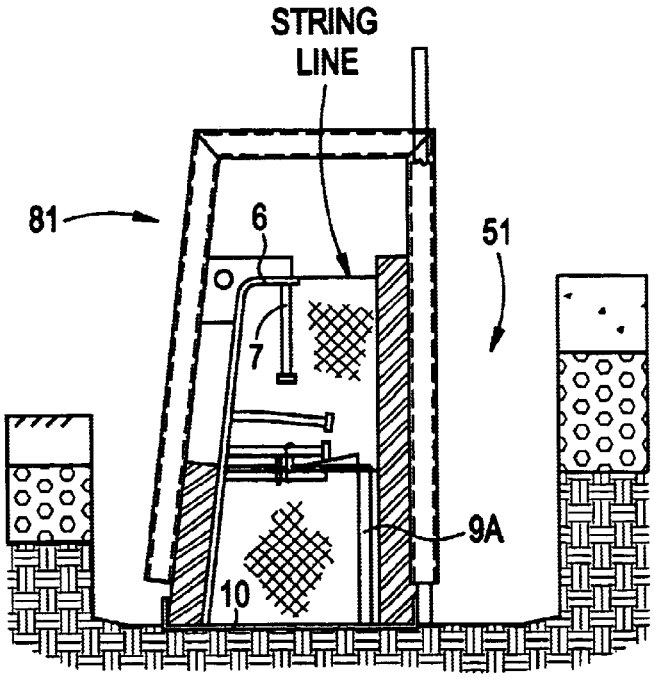
FIG. 13 is an end view of the curb of FIG. 10 tied to a bench and positioned at its final attitude, its face nearly vertical in a trench.

In operation, in laying curved steel faced concrete curbs, as shown in FIGS. 10–13, the curb 27A is first laid on the ground on its front face, see FIG. 10. If this is the first curb to be installed in a curved trench, one bench is wired to one end (trailing end)of curb, one to the center, and another bench to the opposite (leading) end. Generally, however, one bench will already be in the trench, supporting the leading end of the straight steel curb that the curved steel curb will follow in which case a curb, only the center and leading end benches will be wired to the first curved curb. Illustrated in FIG. 11 is a bench wired to the leading end of a curved steel curb. As shown in FIG. 11, the curb bench 9A is on its side with the curb in its bracket 25. The steel curb and bench 9A are then tied together, for example, using metal baling wire 46. A cast iron wedge 44 is hammered in to tighten the wire 46 to keep the bench from falling off. As shown in FIG. 12, the curb and the bench 9, which are attached by the wire 46, are positioned vertically and lifted. As shown in FIGS. 12 and 13, the curb and its attached benches 9 are uprighted and then lowered into the curved trench in their vertical position, usually with a crew of 4 men. The trailing end of the curb (unless it is the first curb of a run) is placed in bracket 25 of the bench supporting the leading end of the previous curb. That end is at the correct line, grade (height) and batter (inclination), as that bench had previously been correctly adjusted relative to the string line 50 and its proximate curb. The bench 9A is then placed on the line and adjusted as to its correct height, by placing or removing dirt under its bottom plate. After an entire run of curved curb and one or two lengths of straight curb following it are in the trench, and generally in position, the benches are moved in or out as necessary so the curb has a smooth and pleasant looking curvature. Next the expansion joint filler located at the end of each curb is placed. Then the bailing wire securing wedge is cut. A set of overlapping splice plates one over the face and the other over the back of both proximate steel curbs are drawn together by a ½×12" bolt passing through the ½" expansion gap between the proximate curbs. The bolt and the exterior splice plate are removed after the concrete slurry hardens. The interior splice plate remains. The expansion joint filler is cut away to clear the interior plate. Wedge 44 is placed at the trailing end of each curb and used to make its batter match the batter of the proximate curb.

The curved curb is now in the trench and is correctly aligned. Concrete forms for curved steel faced concrete curb can be of 1½"×12"×18" or 8" hinged boards ¼" thick plywood, masonite or sheet metal. The forms are placed 6½" from the back of the steel curb, staked and clamped. After an entire run of curbs are correctly positioned on their benches in the curb, with their concrete forms in place, they are secured and sprayed with form oil, which is also done with straight curb. Then the concrete slurry is poured into the molds and allowed to dry, i.e., for one day or less. The forms, on their inner faces, have a removal coating of form oil which prevents the concrete from sticking to the boards, plywood, masonite or sheet metal of the forms.

After removal of the forms, the curved trench is partly filled with a mixture of crushed stone (base), and compacted earth and the sidewalk and road pavement are then laid in place. For example, on the roadway side, 10 inches of concrete may be poured on top of the base, allowed to harden, and then 3 inches of asphalt are laid on top of the concrete to form the road.

Figure 14:
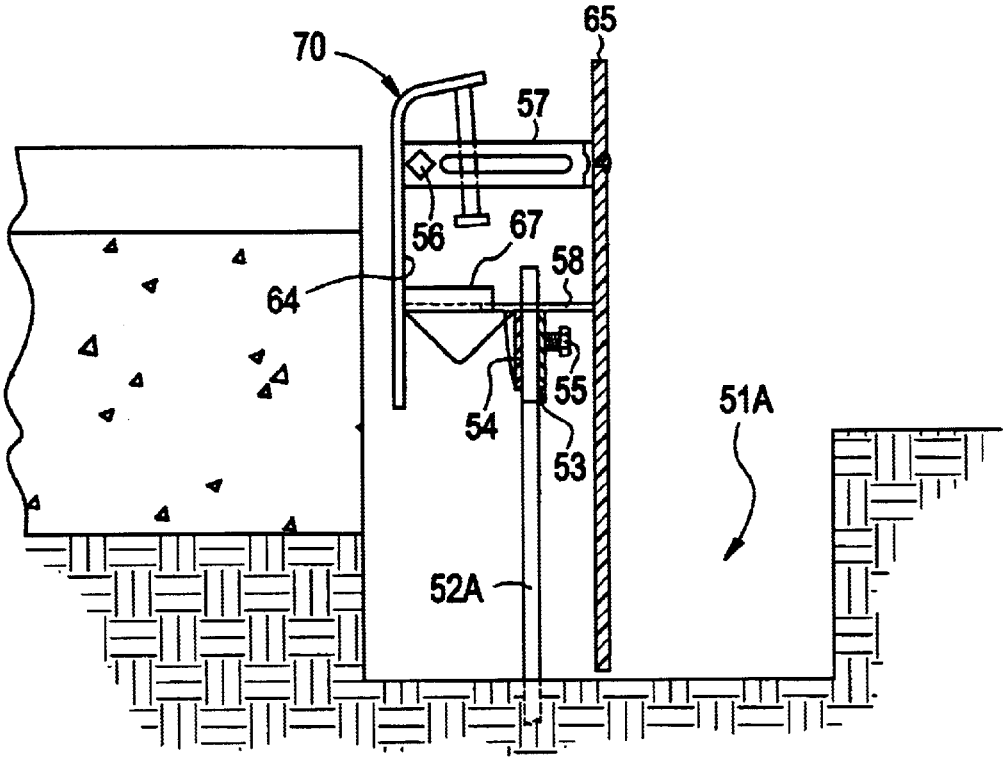
FIG. 14 is an end view of a corner curb, with curb support/standoff bracket and expansion joint filler in a trench.
Figure 15B:
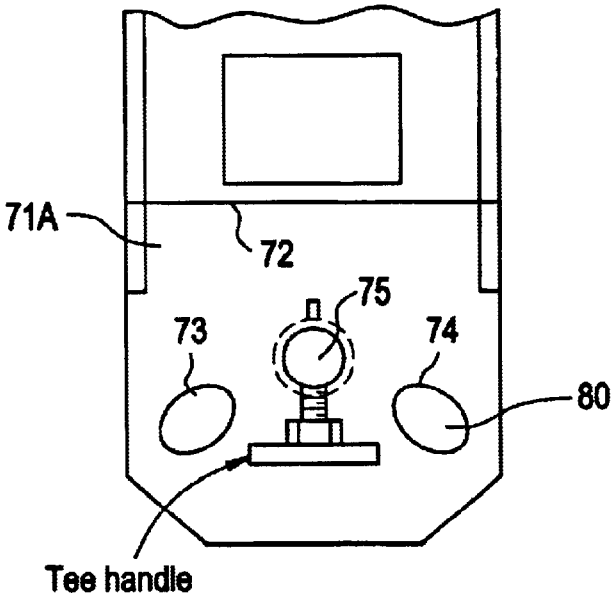
FIG. 15B is a top view, enlarged, of a curb support/standoff bracket used with the corner curb of FIG. 15A.
Figure 15A:
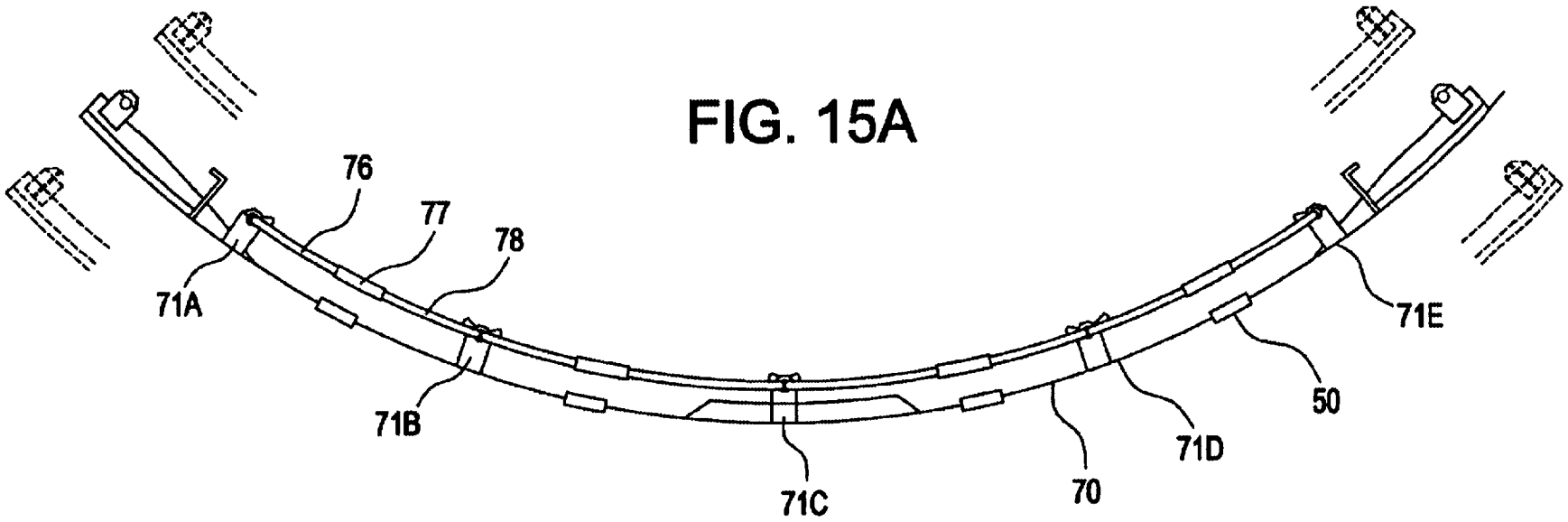
FIG. 15A is a top view of a corner curb of FIG. 14 before the turnbuckles used for modifying the shape of the corner have been removed and before the stakes that hold the shape have been installed.
Figure 16:
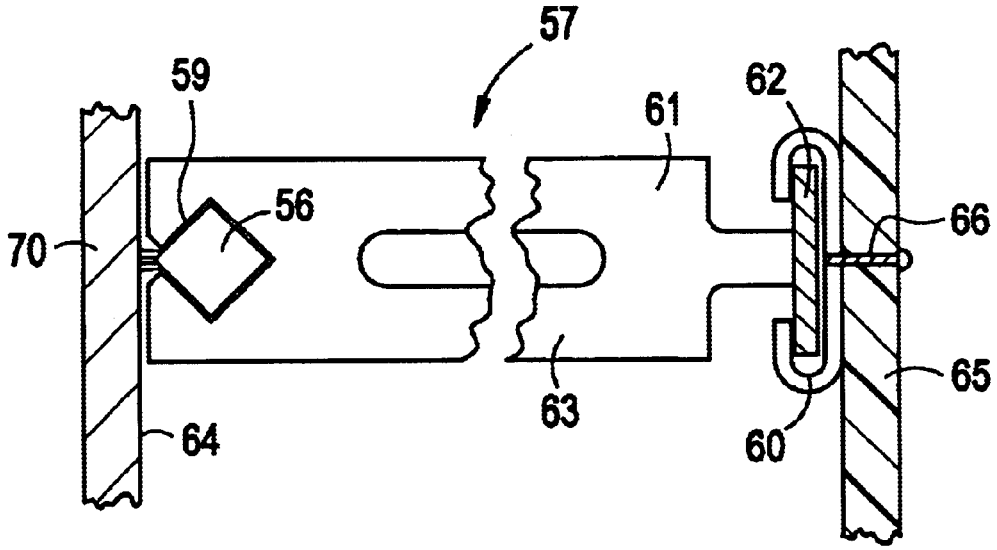
FIG. 16 is a side view of an expansion joint filler tie used with the corner curb of FIG. 14.

A different method and system may be used at corners using a steel corner curb 70, as shown in FIGS. 14–16. The first step in the placement of a steel corner curb 52 is to remove the existing sidewalk and dig trench 51A.

The second step is for the work crew to place three large wood blocks on the floor of the rounded trench. Then they place the steel corner curb on the wood blocks.

If the tangent ends of the steel corner curb do not follow the line of the intersecting streets, the central angle of the steel corner curb is sprung, in or out, so that they do, as shown in connection with FIG. 15.

The corner curb 70 is made to fit the usual corner road site where the two roads intersect at a 90° angle, i.e., an N-S road intersects an E-W road. However, sometimes the roads are not at 90°, but at a different angle, i.e., 89° or 91°, or even less or more, such as 84° to 96°. It is then necessary to change the central angle of the steel corner curb to follow the line of the existing road intersection, e.g., to spring the curb 50 within a range of 84° to 96°.

Figure 17:
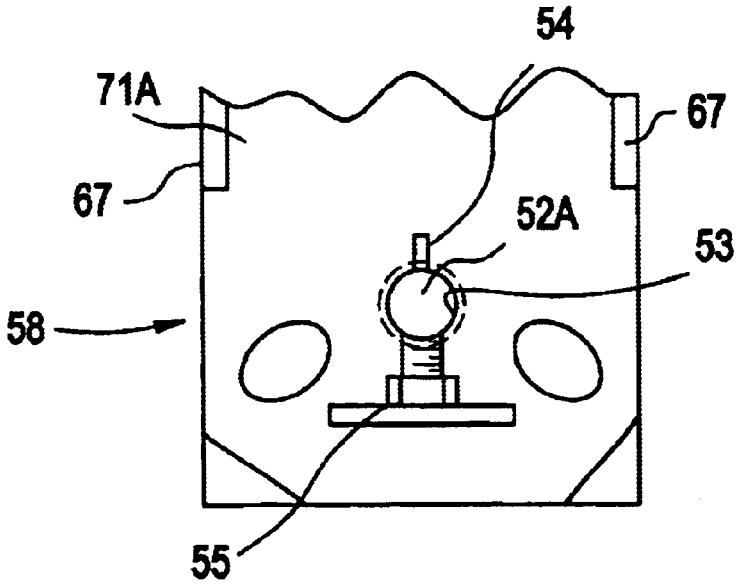
FIG. 17 is a top view (enlarged) of the curb support/standoff bracket used on the steel corner curb.

As shown in the top plan view of FIG. 15, a set of two or four turnbuckles are used to spring the corner curb 70 to the desired angle. The curb 70, whose side cross-sectional shape is the same as curb 70 shown in FIGS. 10–13 has a series of curb support/standoff brackets 71A–71E, with the brackets 71A–71E being at its opposite ends. The description will be of bracket 71A, it being understood that the brackets 71A–71E are the same. As shown in FIG. 17, the bracket 71A has one end 72 welded to the curb 70. The bracket 71A has elongated holes 73,74 to receive the ends of the turnbuckle rods and hole 75. The description will now be of one turnbuckle and its rods, the others being the same. A rod 76 has a bent end engaged in hole 73 of bracket 71A and a screw-threaded portion at its opposite end which is screw-engaged into turnbuckle 77. The rod 78 has a bent end engaged in hole 74 of bracket 71B and its other end is screw-engaged into turnbuckle 77. Rotation of the turnbuckle 77, and the other turnbuckles, will spring in the curved curb 70 into a smaller angle than 90° or, if turned in the opposite direction, will spring out the curb 70 to an angle greater than 90°. Preferably, after the curb is sprung (pulled or pushed) into the desired angle, stakes are inserted into a hole 80 in one bracket and driven into the earth and this is repeated from bracket to bracket. Then all the turnbuckles, and their respective rods, are removed. The stakes hold the curb to the desired angle it was sprung to by the turnbuckles.

Next, using a pry bar placed between one of the wood blocks that was initially placed on the bottom of the rounded trench, and the bottom of the steel curb, the curb is raised to the correct elevation and secured as follows. using the following procedure and system, shown in FIG. 14.

The description which follows will be only of stake 52A and its associated sleeve and brackets, it being understood that the other stakes use the same sleeve and bracket system as is used with stake 52A. The stakes 52A–52D are driven in the ground, at the bottom of 51A. The stake is first passed through tubular sleeve 53. The sleeve 53 is welded to a steel bracket 54 to resist the stack's tendency to lean. This insures that the curb maintains the angle it had been sprung to by the turnbuckle means. The sleeve 53 has a threaded hole to receive a ⅜" tee bolt 55 to lock the sleeve to its stake 52A (pin). The curb may be moved vertically on its stake 52A and then locked, using the sleeve bolt 55 to position the curb 70 at its correct height.

As shown in FIG. 16, curb 70 is formed with a plurality, preferably four, squares 56, welded onto its back face 64, two near the ends and two on each side of the centerline and 48" apart(viewed from above). The present invention provides a special sheet metal bracket member 57 which is associated with each square bar 56. The top bracket member 57 has a square-shaped hole 59 at its front end which fits over the square 56. The back end 61 of the bracket member 57 (see FIG. 16) has a bracket arm 62 perpendicular to the body 63 of the bracket. An inverse C-shaped clamp 60 is placed over the bracket arm 62. The clamp 60 is attached, by two rivets 66, to a continuous flexible ½"×18" or 8" pre-molded expansion joint filler 65 (FIG. 14). The expansion joint 65 is used as to separate the curb from the side walk and thus provide for expansion and contraction. It is left in place in the trench 51A. The curb tie bracket 57 is used to space the expansion joint 65 from the curb 70.

The bracket 71A has three functions. It is the same part as 71B, 71D and 71E in FIG. 15A. It is used to hold the curved steel curb 70 to the angle it was sprung to by turnbuckles. Also, the bracket 71A which is welded to the top of the sleeve 53 and to the curb 50. Thusly, the position of the sleeve determines the vertical height of the bracket 71A and hence the vertical height of the curb 50 and spaces the expansion joint filler. The bracket 71A includes a bent flange portion 67 for strength.

In order to save shipping costs, the curb 70, its brackets are shop-welded to curb but are shipped unassembled. The expansion joint filler is fragile and would need a crate. They are assembled at the job site. At the site the front end of the bracket 57 is placed over the square 56, the expansion joint 65 is curved and the bracket arm 62 is placed into the clamp 60.

The above description is of one curb tie bracket and its associated square bar bracket arm. It will be understood, however, that a curved steel corner curb will typically use 4 stakes, each with its own set of brackets, and that the form 65 will run the entire length of the curb, albeit in two pieces each 114" long.

The description of the systems and methods for installing steel curbs provided in relation to FIGS. 1A–17 are used when the road (roadway) is removed and a wide trench is dug. However, the following two alternative embodiments may be employed when only one, or a few, sections of steel curb are to be replaced, and none of the road is removed. This situation often occurs when a section of sidewalk is badly broken and must be replaced and because of job conditions the curb must also be replaced. For example, only 100 feet of sidewalk and its proximate steel faced concrete curb may be replaced.

Figure 18:
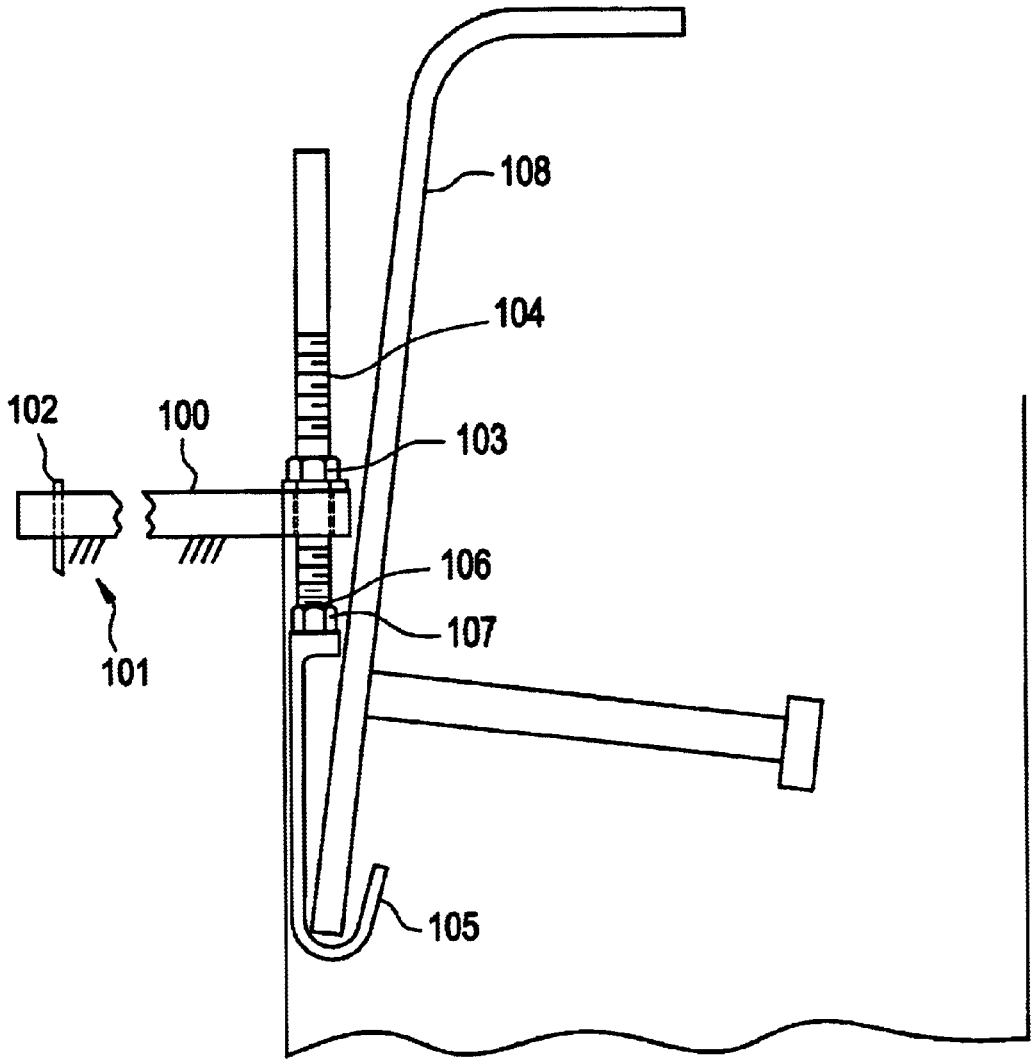
FIG. 18 is a side view of one system for installing a steel curb in a narrow trench which is often used when only the curb and sidewalk are being replaced but not the road.

In the first embodiment, shown in FIG. 18, a flat steel plate 100, which is reusable, is placed on top of the existing road 101. The road 101 is not removed. The plate 100 is correctly positioned on top of the road 101 and a nail 102 is driven through a hole near its proximate end. The nail is driven into the asphalt of the road to hold plate 100 in position. The plate 100, at its opposite distal end, carries an adjustable nut 103 which connects the plate 100 to a vertical threaded steel rod 104. The rod 104, at its bottom, has screw threads 106 which are screwed into screw fitting 107 of a U-shaped steel bracket 105. The bracket 105 is positioned along the edge of the road along an imaginary line connecting the end of the remaining curb at one limit and the end of the remaining curb at the other limit of the new sidewalk and curb. The bracket 105 is correctly positioned and then it supports the bottom edges of either or both the leading and trailing ends of the adjacent steel curb 108 which is laid in the bracket 105. The nut on the threaded rod 104 (hanger bar) is used to adjust the steel curb to the elevation of the existing curb, which remains in place. The concrete is then poured, the rod 104 is unscrewed from the bracket 105, and the rod 104 plate 100 are removed. The bracket 105 stays in the concrete.

Figure 20:
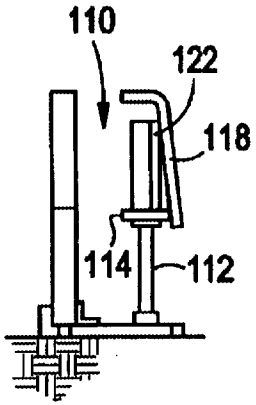
FIG. 20 is a side view of the system of FIG. 19.
Figure 19:
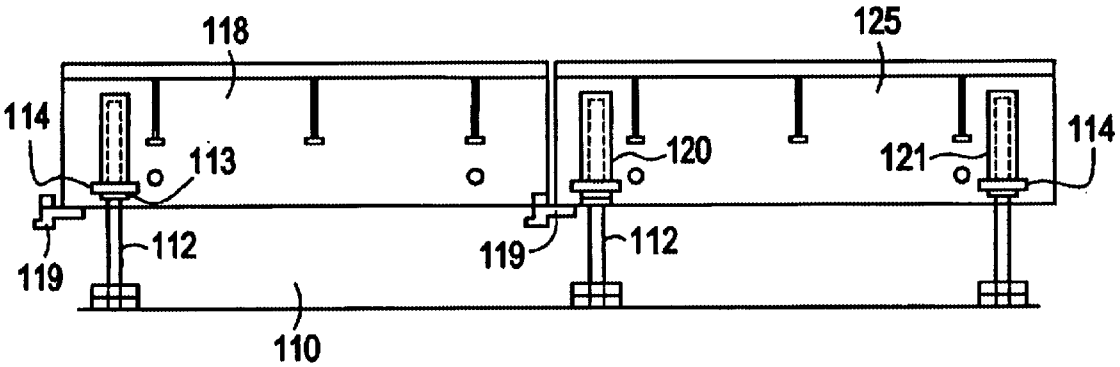
FIG. 19 is a front view of an alternative system for installing a steel curb in a narrow trench.
Figure 21:
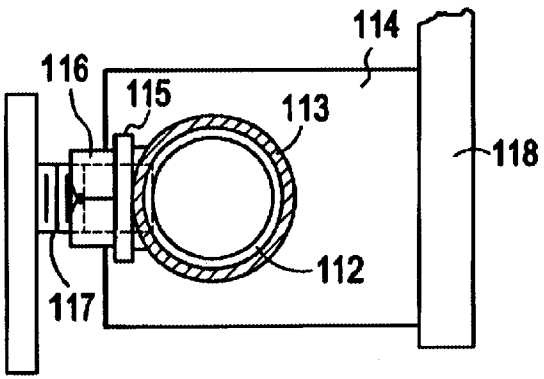
FIG. 21 is an enlarged top view of a bracket which is welded to a steel curb.

An alternative embodiment of a system and method for placing replacement steel curbs without removal of any of the road, is shown in FIGS. 19–21. It uses an extendable leg comprising a rod or tube within a pipe which is similar to that shown in FIG. 14.

The sidewalk and curb are removed and a narrow trench 110 is dug. The tube 112 fits within a pipe (tube) 113 of ¾-inch inner diameter. As shown in FIG. 21, a bracket 114 is welded to the steel curb 118 and has a flange portion 115 which carries a nut 116. A tee bolt 117 is screwed into nut 116 and passes through a hole in pipe 113. When tightened, the tee bolt 117 positions the tube 112 within the pipe 113.

The pipes 120 and 121 are welded at both ends of the ends of the first of a series of curbs 125 at weld point 122, see FIG. 20. A shelf bracket 119 is also welded to curb 125 at its leading end, at its bottom edge, to support and align the next steel curb 118 in the line. That next steel curb 118, which is an otherwise conventional curb, has a pipe 112 of the same type as pipe 120.

In addition, there is also described below a concrete form used to form a concrete curb without a steel curb, especially a corner concrete curb (curved as seen from above). This system is especially useful when a broken curb and sidewalk are being replaced and when a corner must be replaced to provide a handicap ramp to comply with the "Americans With Disabilities Act." The existing road is not removed, but may be patched.

The first step is to remove the damaged curb and sidewalk to form a trench. There is provided a form holder to position and hold the front concrete multi-sectional form. The front form covers only the curb reveal with the remainder of the curb poured against the asphalt and concrete base of the existing road. The form holder also holds an expansion joint filler. This form holder (24" OC.) applies a force to curve a 2×⅛×48"/72" steel plate to the curvature of the curb that was removed.

Figure 22:
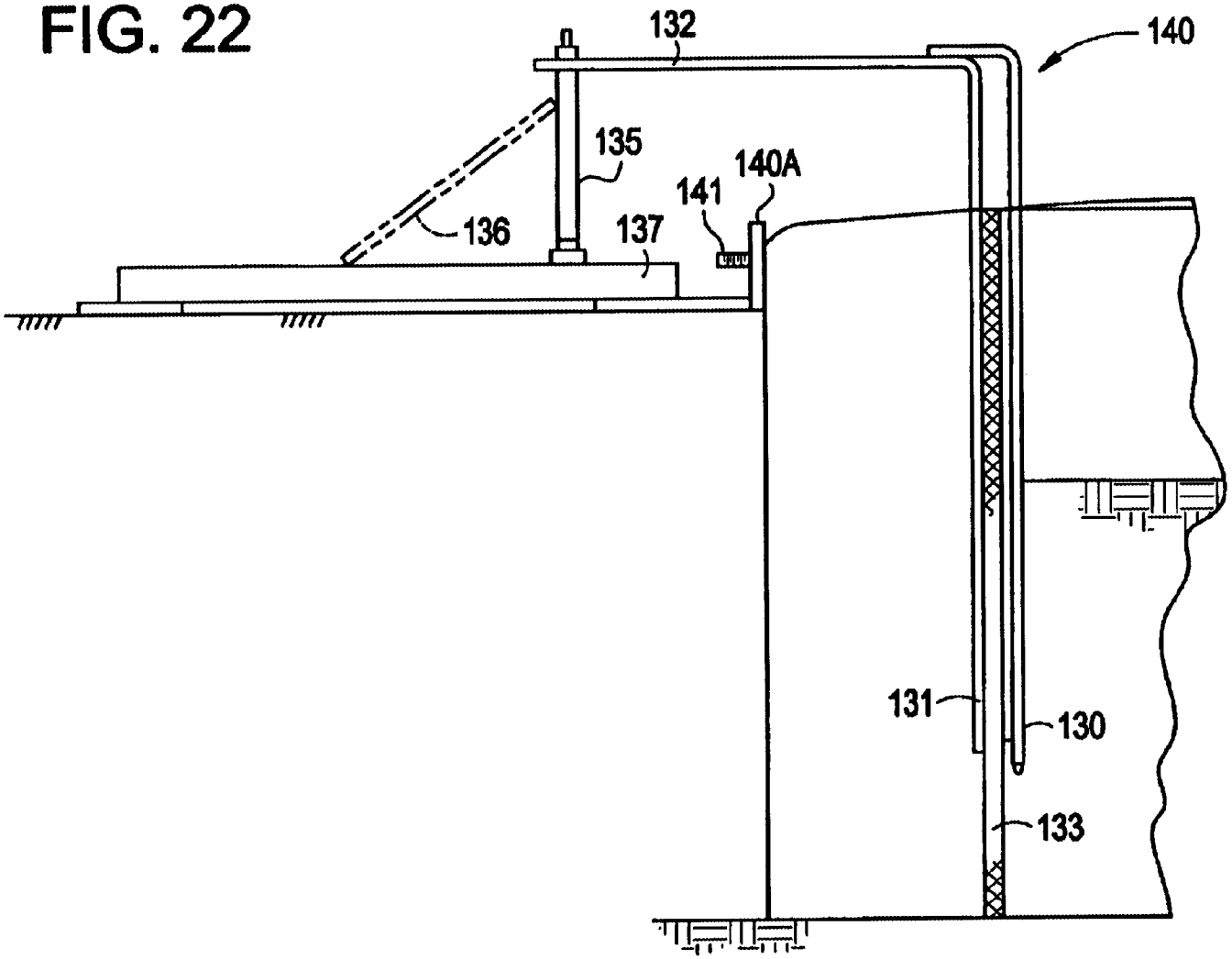
FIGS. 22 and 23 are side plan views of form holders for a concrete curb positioned within a trench.

As shown in FIG. 22, the expansion joint filler holder 140 uses a back vertical steel arm 130, for example, ¼×1½×19¾ inches. The back arm 130 is spaced ½ inch from the front vertical steel arm 131, which is preferably is ¼×1½×29¼ inches. The front arm 131 is bent to form a horizontal arm portion 132, preferably 12 inches long. The premolded bituminous expansion joint filler 133 (expansion joint filler) sheet, which isolates the curb from the sidewalk, is held between the arms 131 and 130. It is preferably ½×18 inch continuous. The curb and sidewalk are poured simultaneously.

The horizontal portion 132, near its free end, has a hole through which a vertical rod 135 protrudes. The rod may be braced by plate 136, if necessary. The rod 135 rests on a plate 137 and is used to position the horizontal arm portion. The plate 137 at its back rests on a ¼"×2"×4" plate and at its front end rests on a bent plate with slotted holes. The front and back plates rest on the road and two nails are driven through two holes in the back plate into the asphalt. The curb form 140 is a steel sheet 2"×⅛" and 48" or 72" long. It has threaded studs 141 welded to it.

For straight concrete curb (without steel facing) for limited repair 20' to 100' a system similar to that of FIG. 18 may be used. The front for plate must be 7" high instead of 2" high and 3/16" thick instead of ⅛" thick.

Figure 23:
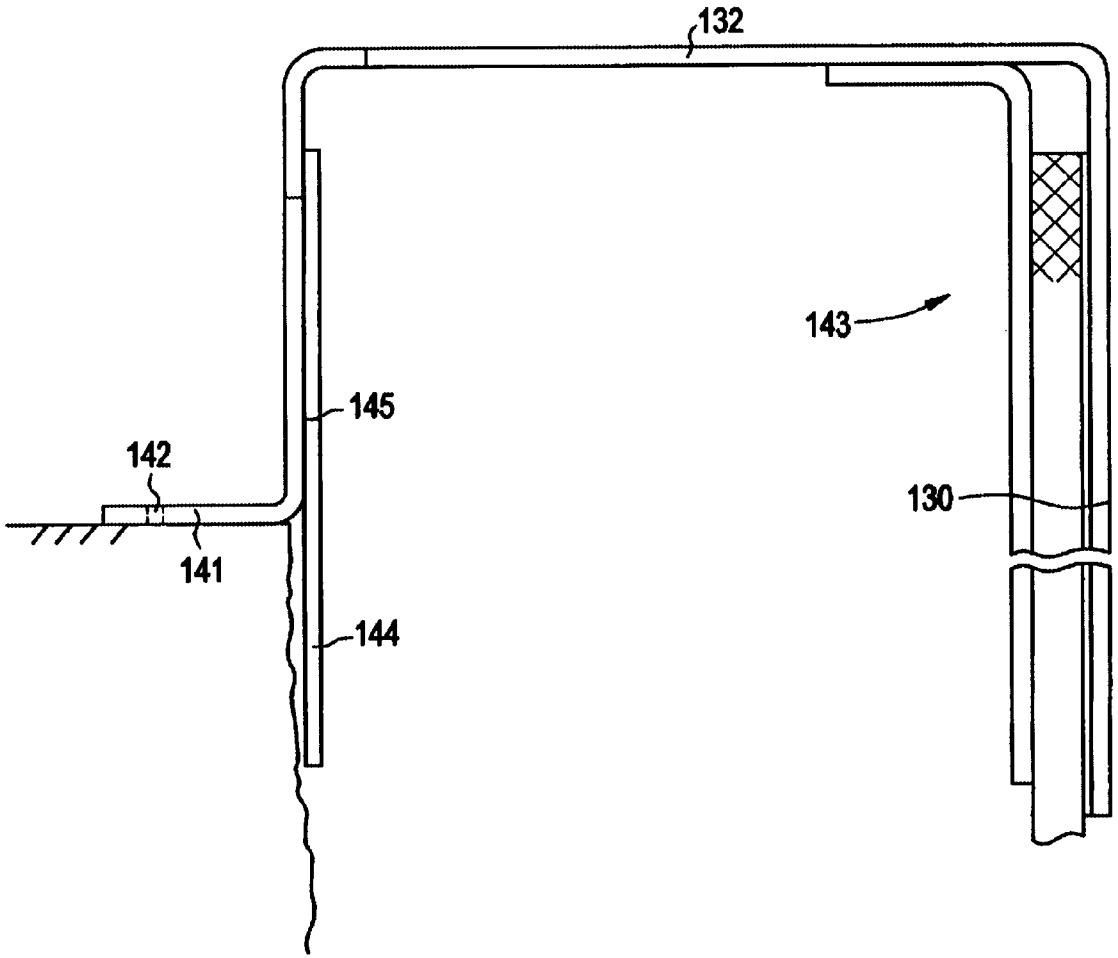

In the embodiment of FIG. 23, the horizontal arm portion 132 is integral with the back arm 130. The arm portion 132 has a descending vertical portion 145 and a horizontal portion 141 having a nail hole 142. A nail is driven through the nail hole 142 into the asphalt of the road to position the form holder 143. The vertical portion 140 holds the front form 144.

What is claimed is:

1. An elongated steel curb and bench laid within a trench having a trench floor, the steel curb having a nearly vertical wall portion adapted to be proximate a roadway and having interior and exterior faces, the steel curb having an integral top horizontal flange portion adapted to be level with a sidewalk and a bottom edge;

the bench being a metal or plastic member having a bottom plate adapted to lie on the trench floor, a front plate, a back plate and a bracket attached to the front plate, the bracket supporting the bottom edge of the curb to position the curb in the trench, and two vertical protrusions on the bottom plate adapted to position a concrete form of lumber.

2. The steel curb and bench as in claim 1 wherein the vertical protrusions are flanges which are integral with the bottom plate.

3. The steel curb and bench as in claim 1 and an inverted U-shaped tubular steel frame adapted to hold front and back concrete forms.

4. The steel curb and bench as in claim 1 and two of said brackets on said bench are adapted to hold the curb at the correct elevation and position one steel curb relative to an adjacent steel curb.

5. An elongated steel curb and a metal bench laid within a trench having a trench floor, the steel curb having a vertical wall portion adapted to be proximate to a roadway and having interior and exterior faces, the steel curb having an integral top horizontal flange portion adapted to be level with a sidewalk and a bottom edge;

the bench being a metal or plastic member having a bottom plate adapted to lie on the trench floor, a front plate, a back plate and a bracket attached to the front plate, the bracket supporting the bottom edge of the curb to position the curb in the trench, the front plate and back plate being welded to the bottom plate by weld lines adapted to shear under pressure from expanding or contracting concrete or having pleats to expand and contract.

6. The steel curb and bench as in claim 1 and an inverted U-shaped tubular steel frame adapted to hold front and back concrete forms.

7. The steel curb and bench as in claim 1 and two of said brackets on each bench adapted to position one steel curb relative to an adjacent steel curb.

8. A method for installing a series of steel curbs, comprising:

(a) digging an elongated trench along a side of a road;

(b) placing a plurality of benches in the trench and aligning each
bench with a string line;
each bench being a metal or plastic member having a bottom plate adapted to lie on the trench floor, a front plate, a back plate, a bracket attached to the front plate, the bottom plate extending beyond the front and back plates and having vertical protrusions forming a front and back channel adapted to hold concrete forms, the bracket being adapted to support the bottom edge of the curb to position the curb in the trench; and (c) placing a steel curb with its bottom edge at its two ends in the brackets of the two benches; and (d) placing a front concrete form in the front channel and a back concrete form in the back channel and pouring a concrete slurry within the said forms.

* * * * *